United States Patent [19]

Palani

[11] 4,069,005

[45] Jan. 17, 1978

[54] METHOD AND APPARATUS FOR PRODUCING HEAT

[76] Inventor: Narayanaswami Palani, 2500, IV Avenue, Annanagar, Madras-40, India

[21] Appl. No.: 681,452

[22] Filed: Apr. 29, 1976

Related U.S. Application Data

[63] Continuation-in-part of Ser. No. 666,422, March 16, 1976.

[51] Int. Cl.[2] ..... F23J 7/00

[52] U.S. Cl. ..... 431/4; 431/190; 431/347

[58] Field of Search ..... 431/2, 3, 4, 126, 190, 431/347; 110/81

[56] References Cited

U.S. PATENT DOCUMENTS

| | | | |
|---|---|---|---|
| 774,447 | 11/1904 | Muth | 431/4 |
| 2,124,169 | 7/1938 | Sheafe | 431/4 X |
| 2,304,706 | 12/1942 | Pollock | 431/347 |
| 2,403,446 | 7/1946 | Lamport | 431/4 |
| 2,713,387 | 7/1955 | Bruhson | 431/190 X |
| 3,787,169 | 1/1974 | Gjerde | 431/347 |
| 3,804,579 | 4/1974 | Wilhelm | 431/190 X |

*Primary Examiner*—Edward G. Favors
*Attorney, Agent, or Firm*—Thomas M. Meshbesher

[57] ABSTRACT

The disclosed method and apparatus for producing heat make use of a fuel/oxygen/water mixture in a reaction zone to provide unusually high temperature effluent gases.

14 Claims, 5 Drawing Figures

METHOD AND APPARATUS FOR PRODUCING HEAT

CROSS-REFERENCE TO RELATED APPLICATION

This application is a continuation-in-part of my copending application, U.S. Ser. No. 666,442, filed Mar. 16, 1976.

FIELD OF THE INVENTION

This invention relates to a process and an apparatus for generating heat energy by burning carbonaceous fuels and for increasing the flame temperature in a combustion zone through the introduction of water into one or more stages of the burning process. An aspect of this invention relates to increasing the temperature output of the combustion of a known fuel with apparatus and a process capable of facilitating the in situ thermosynthesis of combustible gases having a relatively high heat of combustion. Still another aspect of this invention relates to a method for the generation of heat energy and an apparatus suitable for practicing this method, wherein combustion of liquid hydrocarbonaceous fuels is combined with the thermosynthesis of high energy gaseous fuels, and the resulting gaseous fuels are also burned to provide a high flame temperature.

DESCRIPTION OF THE PRIOR ART

In view of the world's shrinking supply of fossil fuels, it has been proposed to find new sources of energy and to improve the efficiency of existing methods and devices for producing energy. Nevertheless, for some time to come, fossil fuels are likely to be heavily relied upon for the world's energy needs. The simplest approach to obtaining energy from a fossil fuel is to initiate its rapid oxidation (burning) in the presence of a cheap source of oxygen such as air. This approach dates back at least to ancient times, when coal fires were used to provide heat. More sophisticated approaches were used on a large scale with the advent of the industrial revolution. As early as 1972, it was proposed to manufacture gaseous fuels from oil. Since that time, a vase technology has developed relating to gasification of liquid and solid fuels.

It has long been known that combustible gases can be synthesized from hydrocarbons, coke, and the like under various conditions. Perhaps one of the oldest examples of such a synthesis is the production of water gas from hot coke and steam by the reaction:

$$C\ (\text{coke}) + H_2O\ (\text{steam}) \rightarrow CO + H_2$$

Many other examples of combustible gas synthesis could be cited, including the synthesis of "producer gas", the formation of methane from water gas (a variation of the Fischer-Tropsch synthesis), and various processes for producing hydrogen, including the steam-hydrocarbon process and the water-gas catalytic process. On either an energy-per-gram of an energy-per-liter (of gas) basis, carbon monoxide cannot be considered a high energy fuel, and it is ordinarily preferred (if high energy is desired) to minimize the production of carbon monoxide in fuel syntheses. If a high energy content per unit volume of gas is desired, hydrogen is the product of choice, while if energy/gram is the criterion, low molecular weight hydrocarbons such as methane are very attractive. For example, water gas (wherein the high-energy hydrogen is significantly "diluted" with carbon monoxide) is often enriched with fuel oil to raise its heating value. This technique involves the injection of oil into the carburetting chamber during the "steam blow" (i.e. during the $C + H_2O \rightarrow CO + H_2$ reaction); the water gas, passing into the carburetor, picks up the oil vapor which is then cracked into gases, includng some methane. (The ordinary water gas reaction typically produces less than 2% by volume of methane.) In most "oil gas"processes, high molecular weight hydrocarbons are cracked with steam to provide combustible gases. In the "Pacific Coast Method", for example, the oil is first burned to bring the gas generator up to temperature (this is analogous to air blast cycle of the water gas process). Next, heated steam, carbon and oil interact to yield a stable combustible gas together with some tar and lampblack, this interacting being referred to as the "make" period. After the "make", carbon deposits are burned off with air.

"Producer gas" is made by continuously passing air and steam through a thick bed of hot fuel. The fuel can be either coal or coke. Because of the continuous influx of air, the nitrogen content of the gaseous fuel product can exceed 50% by volume, while the methane content can be less than 3 vol.-%. A moderately large amount of hydrogen is produced by this process, but typically less than 20 vol. -%.

The formation of methane from carbon monoxide and hydrogen is exothermic; hence a continuous water gas feedstock can be used to produce the methane. However, the heat produced by the reaction may make it difficult to preserve the effectiveness of the catalysts typically used in the methane synthesis. (Typical catalysts include materials containing metals of Group VIII of the Periodic Table, e.g. Ni and Co.) These catalysts are also subject to poisoning, not only by sulfur compounds, but also by the formation of carbon of the catalytic surface. As is known in the art, this type of carbon formation can be minimized by adding a small amount of water vapor to the water gas feedstock, and by using water gas high in hydrogen.

The so-called water gas "shift reaction" (the water gas catalytic process) is also exothermic and produces hydrogen and carbon dioxide from the reaction of carbon monoxide and water. The steam-hydrocarbon process, on the other hand, is highly endothermic and produces hydrogen and carbon oxides from the reaction of high molecular weight hydrocarbons and steam at about 1500° F (about 815° C) over nickel catalyst.

It is also known that the injection of water or steam can sometimes improve the performance of combustion devices, e.g. internal combustion engines.

SUMMARY OF THE INVENTION

This invention is believed to involve the in situ utilization of high grade combustible gases or mixtures thereof produced by the interaction of air, water, and carbonaceous fuels (e.g. fuel oil) in the presence of a catalyst comprising a transitional metal. Although this invention is not bound by any theory, it is believed that the aforementioned interaction is analogous to an oil gas "make" cycle, except that the "make" can be carried out continuously. In this invention, the metallic catalyst is brought up to the desired temperature of well over the ignition point of carbon of nonvolatile hydrocarbon (e.g. 400°-600° C) in a combustion/"make" zone, then the oil is added (in a continuous stream or spray), and subsequently the water is sprayed or dripped, at first in small increments, then continuously. A continuous draft of air or oxygen is provided to the combustion zone. Rapid chemical reactions take place in the water/fuel-/air mixture or interface in the presence of the hot catalyst in the combustion zone as they impinge on said catalyst. This combustion zone is baffled to reflect heat downward toward or along the catalytic surfaces, but the baffles are arranged to also permit an upward flow of product gases or other combustible fluids as residuals. These reactions appear to result in a spontaneously increased draft and a utilization of the soot content of the product gaseous fluid flowing upward out of the combustion zone. At one or more additional locations along this upward flow of said fluids (e.g. in a flue zone), additional impingement surfaces are provided, and introduction of water onto these surfaces (if desired) is facilitated. Additional baffles made of said metallic catalyst can be provided to further speed up the draft and/or insure complete combustion.

An apparatus of this invention, provided with suitably baffled combustion zones and water and fuel inlet means, can be used in a manner analogous to conventional heat generating devices. For example, the apparatus can be combined with one or more heat exchangers and/or water jackets for providing a source of hot air, hot water, steam, or the like. The unusually high temperature and the high velocity flue gases can be taken advantage of also, because of the low content of undesirable by-products of combustion in these gases (e.g. low soot content).

The method and apparatus of this invention is particularly useful whenever flue gases with a temperature in excess of about 800° C are needed (e.g. 800°–1000° C). For example, these flue gases can be useful in so-called "flash" driers, multiple-effect inorganic chemical recovery furnaces, evaporators, and the like. An example of the use of "flash" drying is the rapid drying of aqueous juices to particulate solids through direct contact between the juices and soot-free combustion gases.

Although this invention is not bound by any theory, it is believed that combustible gases such as hydrogen or methane are formed on or near the catalytic surfaces in the combustion/"make" zone, and that subsequent combustion and/or further thermosynthesis and combustion of the product gaseous fluids flowing upward out of the "make" zone increases the flue gas temperatures to the 800° C level (or higher). It is also believed that the combustion and/or "make" reactions in the combustion zone near the said metal catalyst provide a more efficient means of, in effect, atomizing a high molecular weight of carbonaceous fuels, since the said fuel and/or incomplete combustion products are "cracked" and/or converted to highly flammable gases which rapidly diffuse upward from the combustion zone, providing exceptionally good air/fuel mixing, high air draft flow rates, high flue gas flow rates, and high flue gas temperatures. Although the chemical reactions occurring in the catalytic combustion/"make" zone are not clearly understood, it is believed that at least some hydrogen and/or lower alkanes (e.g. methane) are formed in the course of the air/water/fuel reactions.

DETAILED DESCRIPTION

Figure 1:
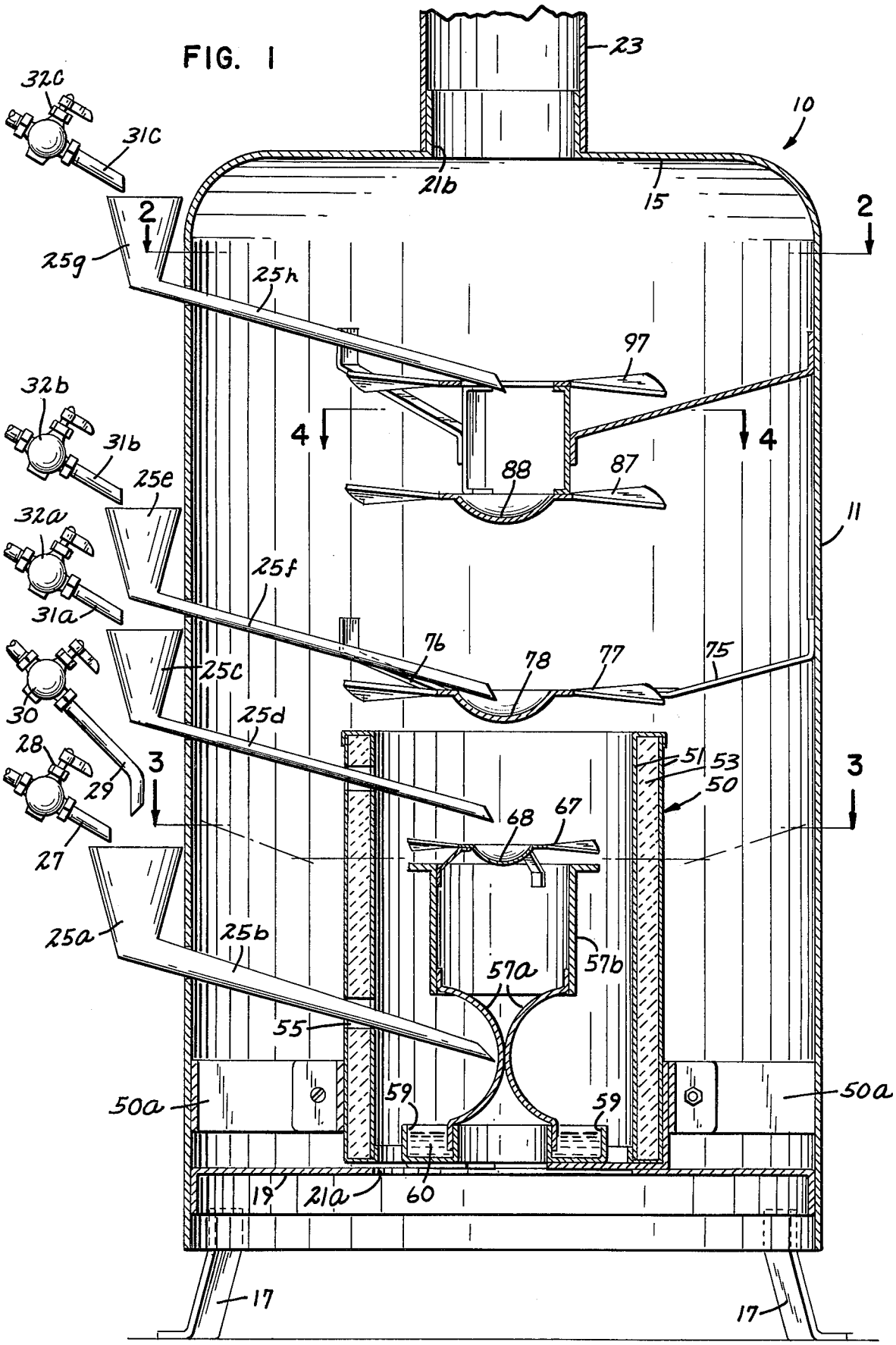
FIG. 1 is a fragmentary cross-section view of a heat-generating apparatus designed to demonstrate this invention.

As is well-known in the art of thermal energy production from carbonaceous fuels, the reaction between carbon and oxygen involves a substantial negative enthalpy change, thereby releasing thermal energy. When carbonaceous fuels are burned, this release of thermal energy is ordinarily accompanied by the formation of carbon dioxide; however, incomplete combustion products can also be formed, e.g. "soot" (which primarily comprises elemental carbon), "tar" (which comprises polymers such as polymerized hydrocarbons or oxygenated hydrocarbons), carbon monoxide, and the like. Thus, every molecule of carbon monoxide and every particle of tar or soot formed represents a loss of potentially recoverable thermal energy. By-products such as soot or carbon monoxide also present the possibility of synthesizing combustible gases through interaction with combustion products or reactants. Although this invention is not bound by any theory, it is believed that the water (preferably liquid water) introduced into the first or lower or primary reaction zone of an apparatus of this invention can assist in the formation of combustible gases, thereby creating the possibility that at least some sensible heat potential can be recovered, soot levels in the flame can be eliminated, flame temperatures can be increased, the flue gas temperatures and efflux velocities can be increased.

As will become apparent from the following description, this invention contemplates a heat-generating process which comprises the continuous introduction of a solid or liquid fuel, oxygen, and water into a preheated first reaction zone. In its simplest aspect, this continuous introduction step involves adding the water to a continuous stream of said solid or liquid fuel and providing openings in the bottom of the first reaction zone, so that an oxygen-containing gas (preferably air) can flow in as a draft and intimately contact the said fuel and water. The result is a fuel/oxygen/water interface or mixture. The first reaction zone contains a catalytic surface comprising a transition metal, e.g. a metal from Group VIII of the Periodic Table, preferably nickel. As is known in the art of catalysis, the metallic nickel can be in plate form (as nickel or nickel alloy plate), in a finely divided form, or in the form of mixtures of nickel and kieselguhr. In the preferred practice of this invention, the catalytic surface has a vertical component, so that fuel can be caused to flow downward or pulverized fuel blown onto or along the surface. Since the surface should be preheated (e.g. preheated to a temperature well above the ignition point of carbon and/or nonvolatile hydrocarbons), it can be advantageous to introduce the said fuel along, without water, onto the catalytic surface and burn the fuel with air on this surface until the desired temperature has been reached. Then, the water can be added (e.g. added directly to the fuel), so that a fuel/water mixture flows downwardly along or blown against the said catalyst surface, and an air/fuel/-water interface or mixture is provided or facilitated.

The fuel/water/oxygen mixture or interface, particularly at temperatures well above the ignition point mentioned previously, forms hot gaseous reaction products in the presence of the catalytic surface. A portion of these gases is permitted to flow upward in a rapid stream, while some of the gases are deflected backward (i.e. upsteam, which would normally be in a downward direction). The upstream deflection of hot gaseous reaction products helps to maintain the catalytic surface at the desired temperature and to maintain any high-grade combustible gas syntheses (e.g. hydrogen or lower alkane formations) which may be occurring at or near the catalytic surface. Thus, it is ordinarily unnecessary, in the practice of this invention, to alternate air blast and steam "blow" cycles, as in the case of water gas syntheses. Furthermore, any high-grade combustible gases formed in the first reaction zone are utilized in situ within the heat-generating zone in the apparatus. Although this invention is not bound by any theory, it is believed that a portion of the freshly synthesized combustible gases is utilized in the first reaction zone, and the balance of these gases is utilized in subsequent (i.e. downstream) reaction zones, which will be described subsequently.

At least one additional reaction zone is preferably located downstream from the first reaction zone. This downstream location need not be above the first reaction zone, but in most cases it will be. It is sometimes desirable to include at least one reaction zone in a flue means communicating with the interior of the thermal energy-generating apparatus. In the second (and/or subsequent) reaction zones, water can also be introduced. The function of the water in these subsequent zones is believed to serve as a means for converting soot or other partial combustion products into high-grade combustible gases. Baffle means are provided downstream from the second or subsequent reaction zones, so that the upstream deflection and impingence principle described previously can be used in connection with these zones also.

For convenience, the gases emerging or emanating from the second or subsequent reaction zones is referred to as the "flue gas".

Heat energy can be obtained from this "flue gas" by any conventional means. For example, the flue gas can be directed into a direct heat transfer zone for the rapid evaporation of water from a dilute aqueous solution of nutrients, inorganic salts, or the like (the so-called "flash" drying technique). Alternatively, and preferably, heat exchanges are placed around the first and/or second reaction zones of a like apparatus of this invention, whereby the sensible heat is used to heat air, water, or the like. In another embodiment of this invention, heat exchanges are placed in contact with the flue also. Still another conventional means for obtaining or withdrawing heat from the thermal-generating apparatus is to provide a water or steam jacket around a reaction zone or about the flue. Any of these heat transfer or heat exchange techniques can be used, provided the first reaction zone is not cooled down below the point at which the desired combustible gas syntheses take place.

As noted previously, substantially pure nickel can be used as a catalyst, since it has a melting point well in excess of 800° C. Nickel alloys are also suitable, and some catalytic action can be obtained even when the nickel content of the alloy is as low as 6%. The melting point of the alloy should also be well above 800° C.

The fuel used in this invention is preferably nonvolatile and should be carbonaceous (i.e. physically or chemically containing carbon), most preferably hydrocarbon, hydrocarbonaceous fuels. (The term "hydrocarbonaceous" is used herein to denote compounds which consist essentially of carbon and hydrogen, e.g. alkanes, alkenes, alkynes, cycloaliphatics [including cycloalkanes and cycloalkenes], aromatics, etc.; however, a minor amount of functional group content can be included in the hydrocarbonaceous fuels. Typical of such functional group content are the groups normally occurring in some petroleum distillates and/or oxygen-containing functional groups such as hydroxyl, alkoxy, carbonyl, etc.) The preferred hydrocarbonaceous fuel is fuel or other predominantly hydrocarbon fuels having an initial boiling point above 100° C. Fuel oils, and particularly fuel oils mixed with elemental carbon are normally considered to have a very high heat value. A principal problem with such fuels is the difficulty of adequately atomizing them or the difficulty of maintaining suitable atomizing equipment due to clogging problems and the like. This invention is believed to avoid such problems, since atomization of the fuel, though desirable, is not required. One effective practice of this invention simply imvolves providing a continuous stream of liquid, high-carbon, high molecular weight hydrocarbon, which stream is directed onto the aforementioned catalytic surfaces in the first reaction zone.

Turning now to the Drawing, wherein like numerals denote like parts in the various views, the outer structure of a heat-producing apparatus 10 of this invention includes an outer shell 11 defining an enclosed inner space in which combustion reactions can take place, supports 17 for said outer shell, base plate 19 for closing off the bottom end of said shell 11 and for defining an opening **21*a* for the air draft into the interior of the shell, opening 21*b* for permitting upward efflux of gases from the interior of shell 11, and flue 23 for conducting these gases away from the interior of shell 11. Shell 11 can comprise metal and/or ceramic materials having a melting or softening range substantially in excess of 800° C. It is ordinarily preferred that shell 11 be comprised of nickel or a nickel alloy, to further assist in the catalytic action which takes place within the interior of shell 11. Heat exchangers (not shown) can be placed in heat exchange relationship with shell 11 and/or flue 23. Alternatively, a water or steam jacket can be provided around shell 11 and/or flue 23; if a water jacket is used, the melting or softening range of the material used to make shell 11** is far less important.

If the only purpose of apparatus 10 is to provide thermal energy which is to be transferred to a steam jacket, heat exchanger, or the like, flue 23 may exhaust directly into the atmosphere. On the other hand, if the hot flue gases in flue 23 are to be used for "flash" drying, flue 23 may be arranged to be in communication with an evaporation chamber.

The water and fuel delivery system of apparatus 10 is generally shown by fuel/water delivery means **25*a* and 25*b*, additional water delivery means (e.g. 25*g* and 25*h*), and the outlets from water line 27, fuel line 29, and additional water lines (e.g. water line 31*c*). Water line 27 is connected to a source of water (not shown), while fuel line 29 is connected to a source of fuel (also not shown). The gravity flow of water and fuel is controlled by flow control means, which are shown in the Drawing as valves or stopcocks, valve 28 controlling the water line 27, valve 30 controlling the fuel line 29, valve 32*c* controlling water line 31*c*, etc. All of the water delivery means shown in the Drawing, with the exception of water line 27, cup means 25*a***, and tube means 25*b*, are optional. However, it is ordinarily preferred to include at least one additional water inlet for the second reaction zone, which will be described subsequently.

Figure 5:
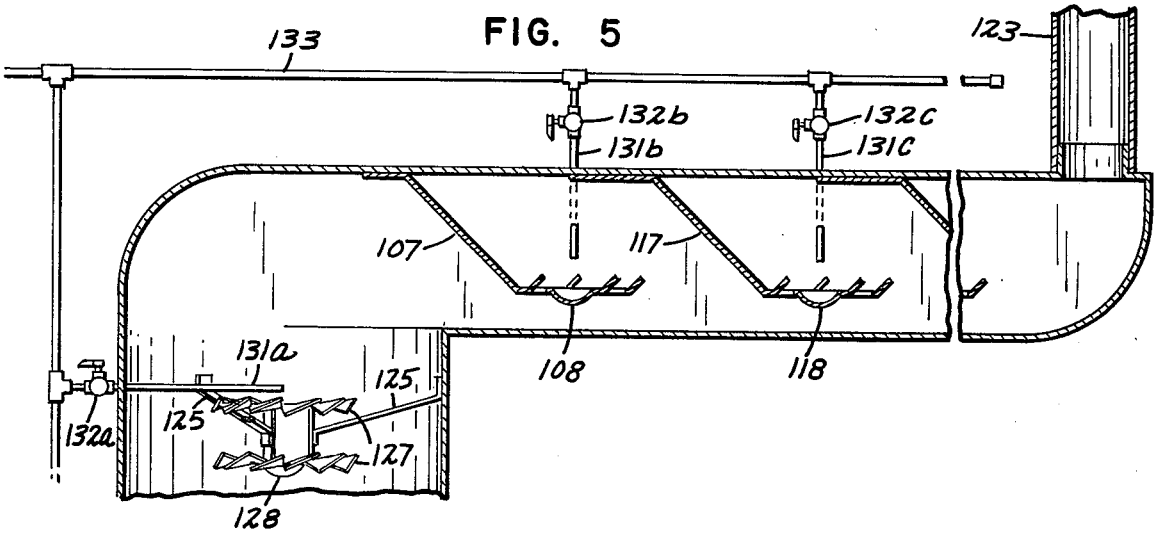
FIG. 5 is a fragmentary cross-sectional view showing a flue structure suitable for use with the apparatus shown in FIG. 1.

The first or primary reaction zone of apparatus 10 is defined by fire vessel 50, which fire vessel is supported in place by support members 50*a* and base plate 19. It is ordinarily preferred that the inside cross-sectional area of fire vessel 50 be substantially coextensive with opening 21*a* in base plate 19. Fire vessel 50 has an enclosed cylindrical interior, open at its top and bottom ends. This cylindrical interior is defined by a wall structure comprising metallic liner means 50 and refractory core 53. Liner means 51 can comprise the aforementioned catalytic metal (e.g. nickel). Although this invention is not bound by any theory, it is presently believed that nickel has some very useful chemical properties, including empty orbitals for excited states and the ability to chemisorb carbonaceous gases such as carbon monoxide. (According to the chemical literature, these same properties are shared by other elements of Group VIII of the Periodic Table, but nickel is clearly preferred for use in this invention.) Because of the effectiveness of nickel as a catalyst in this invention, all metallic surfaces shown in the Drawing can comprise a significant amount of nickel, e.g. at least 6% by weight. It can even be desirable to use nickel throughout flue 23, although, needless to say, some portions of the flue such as the final vent or exhaust 123 (FIG. 5) need not possess any catalytic properties. Fire vessel 50 has an opening 55 for the tube 25*b*. The outlet from tube 25*b* is approximately in the "heart" of the reaction zone defined by fire vessel 50. It is particularly important that the metallic surfaces within this reaction zone have good catalytic capabilities. These catalytic surfaces are designed to retain substantial amounts of heat, to provide surfaces on which fuel/air/water interfaces can be formed, to direct a portion of the product gases produced in the fire vessel 50 upward, and to deflect downward or concentrate other portions of these product gases. By a combination of reflection, refraction, conduction, convection, and the like, an intensely hot burning zone is maintained between circular trough 59 and baffle or reflector means 67. Thus, among the catalytic surfaces, baffles, and deflectors in fire vessel 50 are concave, generally vertical catalytic baffles 57*a*, which receive the fuel or fuel/water mixture, a cylindrical combustion chamber 57*b*, open at its top and bottom ends, and baffle 67 supported in closely spaced relation to the open upper end of combustion chamber 57*b*. The aforementioned circular trough 59 receives any liquid fuel run off from concave catalytic surfaces 57*a*. During the preheating of fire vessel 50, there may be substantial run off of fuel 60 in trough 59. This fuel 60 can burn at its upper surface. After preheating, and when the fuel/air/water reactions are fully under way, run off into trough 59 normally ceases, and combustion is fully initiated along surfaces 57*a*.

Figure 2:
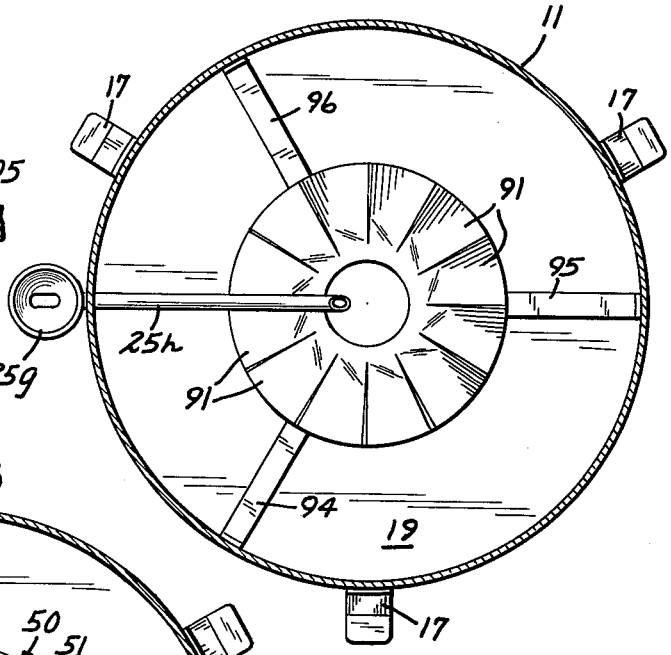
FIG. 2 is a cross-sectional view taken along line 2—2 of FIG. 1.
Figure 3:
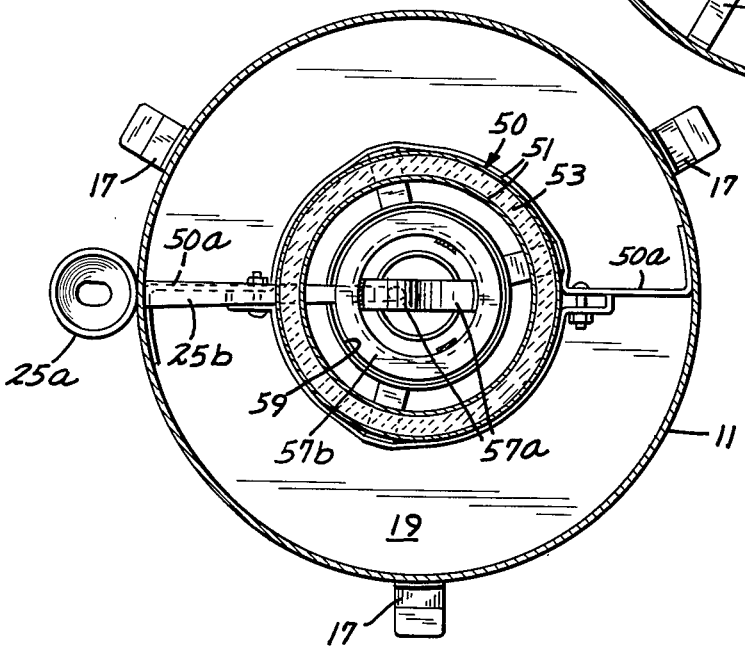
FIG. 3 is a cross-sectional view taken along line 3—3 of FIG. 1.

As noted previously, it is preferred to include at least one additional reaction zone downstream from (in the case of the embodiment shown in the Drawing, above) fire vessel 50. Such a reaction zone can comprise, for example, the space between the upper surface of baffle 67 and the lower surface of baffle 77 or the upper surface of baffle 77 and the lower surface of baffle 87 or the upper surface of baffle 87 and the lower surface of baffle 97 or the upper surface of baffle 97 and under surface 15 of shell 11. It is also preferable to include at least one additional reaction zone within flue 23, which additional reaction zone will be discussed later in connection with the description of FIG. 5. The upper surface of baffle 67 has a depression 68 for receiving water from tube 25*d*; baffle or deflector 77 has a similar depression 78; baffle 87 has a depression 88; etc. Support means 75 and 76 are provided for baffle 77; support means 95, 96, and 94 (FIGS. 2 and 4) are provided for baffles 87 and 97, and similar supports are provided for supporting baffle means 67 in spaced apart relationship from combustion zone 57*b*.

To provide further reaction zones in flue 23, additional baffling or deflecting devices 107, 117, and 127 are included along the length of the passage through the flue 23. Baffle means 127 is supported by member 125 in the same manner as baffles 87 and 97. Depression 128 is constructed and arranged to receive water from tube 131*a*, which is connected to water line 133 through valve or stopcock 132*a*. Similarly, water inlets 131*b* and 131*c*, controlled by valves 132*b* and 132*c*, respectively, permit water to be introduced from water line 133 into depressions 108 and 118 in baffle means 107 and 117, respectively. Ordinarily, the gases passing out of the final section 123 of flue 23 are simply exhausted into the atmosphere. Because of the additional reaction zons in the path of flue gas, it is believed that the only gases passing through this final section 123 are water and carbon dioxide in a substantially soot-free condition.

Figure 4:
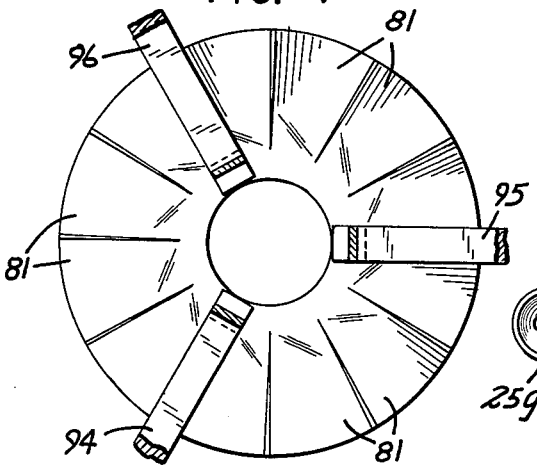
FIG. 4 is a cross-sectional view taken along line 4—4 of FIG. 1.

In the preferred embodiment shown in the Drawing, each baffle means (67, 77, etc.), in addition to the dish or depression (68, 78, etc.) is provided with vanes, e.g. vanes 91 (FIG. 2) and 81 (FIG. 4). These vanes radiate out generally horizontally from the dish or depression portions of the upper surfaces of the baffles. These baffles are believed to play the role of collecting the heat from the combustion emanating from the "make" zone and to reduce the carbon with steam for the formation of methane which spontaneously burn out with the addition of the oxygen in the ambient air.

OPERATION OF THE APPARATUS SHOWN IN THE DRAWING

To operate the apparatus shown in FIG. 1, the interior surfaces of fire vessel 50 are first heated up. A blow torch or other source of heat can be used for this purpose. Alternatively, any liquid combustible fuel can be introduced through tube 25*b*, including relatively low molecular weight liquids such as lower alkanols, ethers, lower alkanes, and the like. Ordinarily, the fuel (e.g. fuel oil) from line 29 is used to initiate combustion and preheat fire vessel 50. The exact temperature to which the catalytic surfaces of fire vessel 50 must be brought is well above the ignition point of carbonaceous fuel. It is believed that this temperature should be in excess of 800° C, since this range of temperatures work well in practice, and since many of the nickel-catalyzed reactions (such as the steam-hydrocarbon reaction) proceed effectively at this temperature. After a high temperature has been reached within fire vessel 50, using ordinary combustion of hydrocarbon fuel or the like, water is introduced from line 27 in very small increments. If the fuel/air/water interface on surface 57*a* is at a sufficiently high temperature (e.g. 800°–1000° C), a sudden flaring or intensification of the flames within fire vessel 50 will be observed. An apparently related observation is the increased draft through opening 21*a* and the increase in flue gases from as low as 500°–600° C up to more than 800° C (but typically less than 1200° C). Once this flaring and increased air draft through opening 21*a* has been observed, the rate of water introduction can be increased until it is smooth and continuous, rather than incremental and continuous. The ratio of the volume of the water stream to the fuel stream can desirably vary, depending upon the carbon content of the fuel, high fuel carbon contents being capable of reacting with a somewhat greater flow of water. Under optimum conditions, the fuel flow/water flow ratio (by volume) can be approximated and/or controlled, e.g. at a 1:1 ratio.

The increased air draft through opening 21*a* becomes very vigorous and ordinarily need not be assisted by any blowing or pressurizing means. Furthermore, the air draft is sufficiently rapid to provide a high velocity stream of gases over and around and upward from baffles 67, 77, etc. and up toward opening 21*b* into flue 23. The flue gas velocity into and through flue 23 is also high, thus permitting the use of heat exchangers in heat-exchange relationship with flue 23 without slowing down the flue gas velocity below levels needed for adequate exhaustion through section 123 into the atmosphere.

Of course, it should be understood that the apparatus illustrated in the drawing is merely representative of any number of furnace or burner structures which can be used to practice the process of this invention.

What is claimed is:

1. The heat generating process which comprises:

a. continuously introducing a carbonaceous fuel, oxygen, and water into a preheated first reaction zone, said preheated first reaction zone containing a first catalytic surface comprising a transition metal;

b. permitting the resulting fuel/water/oxygen mixture to form hot gaseous reaction products in the presence of said catalytic surface;

c. deflecting a portion of the sensible heat produced by said steps (a) and (b) back into said first reaction zone, while simultaneously passing a gas steam comprising said hot gaseous reaction products and unreacted oxygen upwardly out of said first reaction zone into a second reaction zone containing a second catalytic surface, whereby any unburned combustible reactants in said gas stream are burned to produce additional hot reaction products in said second reaction zone;

d. deflecting a portion of the sensible heat produced in said second reduction zone back toward said first and second reaction zones, whereby the elevated temperature of said first and second catalytic surfaces can be continuously maintained and the catalytic action in said first and second reaction zones can be continuously maintained, while simultaneously passing a flue gas stream out of said second reaction zone toward a flue gas opening; and e. obtaining heat energy from said flue gas stream.

2. A process according to claim 1 wherein:

f. said first reaction zone includes a catalytic surface comprising nickel, said surface being preheated to at least about 800° C.;

g. said hydrocarbon fuel is a liquid hydrocarbon having an initial boiling point in excess of 100° C.;

h. said oxygen is introduced by permitting an air draft to flow upwardly through said first reaction zone over said first catalytic surface;

i. said liquid hydrocarbon is introduced in a continuous downwardly flowing stream onto said first catalytic surface;

j. said water is introduced into said continuously downwardly flowing stream;

k. said hot gaseous reaction products are brought to a temperature of at least about 800° C. and said gas stream comprising said hot gaseous reaction products is directed over said second catalytic surface.

3. A process according to claim 2 wherein said first and second catalytic surfaces comprise a metallic alloy, said alloy comprising at least 6% by weight of nickel.

4. A process according to claim 3 wherein said alloy has a melting point higher than 800° C.

5. A process according to claim 1 wherein water is introduced into said second reaction zone.

6. An apparatus for the production of thermal energy comprising:

a. a fire vessel open at its upper and lower ends, the opening in said lower end being in fluid communication with a source of oxygen;

b. a first catalyst surface comprising a transition metal for the promotion of chemical reactions between oxygen, carbonaceous fuel, and water, said catalyst surface being generally disposed within said fire vessel;

c. a source of water external to said apparatus;

d. a source of carbonaceous fuel external to said apparatus;

e. fuel introducing means for delivering said carbonaceous fuel from said source of fuel onto said first catalytic surface within said fire vessel;

f. first water delivering means for delivering water from said source of water to said apparatus and for thereby forming oxygen/fuel/water interfaces within said fire vessel after combustion is underway in said fire vessel;

g. means for downwardly deflecting a portion of the heat and product gases produced in said fire vessel back into said fire vessel and for directing a portion of the said product gases onto a second catalyst surface spaced apart from said fire vessel;

h. means for deflecting a portion of any further product gases produced in the presence of said second catalyst surface back toward said second catalyst surface and for directing a gas stream toward a flue means;

i. flue means communicating with the interior of said apparatus.

7. The apparatus according to claim 6 further comprising a second water delivery means for delivering water onto said second catalyst surface.

8. The apparatus according to claim 6 wherein said metallic catalyst surfaces comprise nickel.

9. The apparatus according to claim 6 wherein said metallic catalyst surfaces comprise a nickel alloy, wherein said nickel alloy contains at least six percent nickel and has a sufficiently high melting point to withstand the temperatures generated within said fire vessel without melting.

10. The apparatus according to claim 6 wherein said metallic catalyst surfaces include the interior surface of said fire vessel.

11. The apparatus according to claim 6 wherein said metallic catalyst surfaces include a plurality of surface members centrally located within said fire vessel and longitudinally spaced apart therein, each of said surface members having vane portions extending horizontally radially outward to impart a radially outward motion to the product gases passed through said vane portions and to provide a greater surface area over which the gases may pass.

12. An apparatus according to claim 6 wherein said first water delivering means delivers the water into a stream of carbonaceous fuel introduced by said fuel introducing means.

13. The apparatus according to claim 6 wherein said metallic catalyst surfaces each comprise a surface member having a centrally located dish portion and a plurality of vane members extending horizontally radially outward from said dish portion.

14. The heat generating process which comprises:

a. continuously introducing a carbonaceous fuel, oxygen, and water into a preheated reaction zone, said preheated reaction zone containing a catalytic surface comprising a transition metal;

b. permitting the resulting fuel/water/oxygen mixture to form hot gaseous reaction products in the presence of said catalytic surface;

c. deflecting a portion of the sensible heat produced by said steps (a) and (b) back into said reaction zone, while simultaneously passing a gas stream comprising said hot gaseous reaction products and unreacted oxygen out of said reaction zone;

d. obtaining heat energy from said gas stream.

* * * * *